United States Patent [19]

Augustin

[11] 4,358,894

[45] Nov. 16, 1982

[54] COMPASS PENCIL CLAMP

[75] Inventor: Georg Augustin, Port Jervis, N.Y.

[73] Assignee: A & W Products Company, Inc., Port Jervis, N.Y.

[21] Appl. No.: 218,434

[22] Filed: Dec. 19, 1980

[51] Int. Cl.[3] ..... B43L 9/24

[52] U.S. Cl. ..... 33/27 B; 33/149 H; 33/152 B

[58] Field of Search ..... 33/27 B, 149 H, 152 B, 33/173

[56] References Cited

U.S. PATENT DOCUMENTS

| | | | |
|---|---|---|---|
| 2,045,298 | 6/1936 | Hanle | 33/155 |
| 2,582,585 | 1/1952 | De Cesaris | 33/27 B |
| 2,764,816 | 10/1956 | De Cesaris | 33/27 B |
| 3,020,641 | 2/1962 | Augustin | 33/27 B |

FOREIGN PATENT DOCUMENTS

| | | | |
|---|---|---|---|
| 20300 | of 1898 | United Kingdom | 33/152 B |
| 438993 | 11/1935 | United Kingdom | 33/27 B |

*Primary Examiner*—Charles E. Phillips

*Attorney, Agent, or Firm*—Amster, Rothstein & Engelberg

[57] ABSTRACT

A drawing compass having two legs is provided with a writing implement or pencil clamp in the form of a cylindrical band having a side opening. A longitudinally extending flexible rib is provided which projects inwardly into the channel formed by the cylindrical band. The rib facilitates the accurate securement of the writing implement within the clamp.

Additionally, fully functional clamping levers are disclosed which are both cheaper and easier to manufacture than those previously used.

1 Claim, 7 Drawing Figures

Fig. 1.
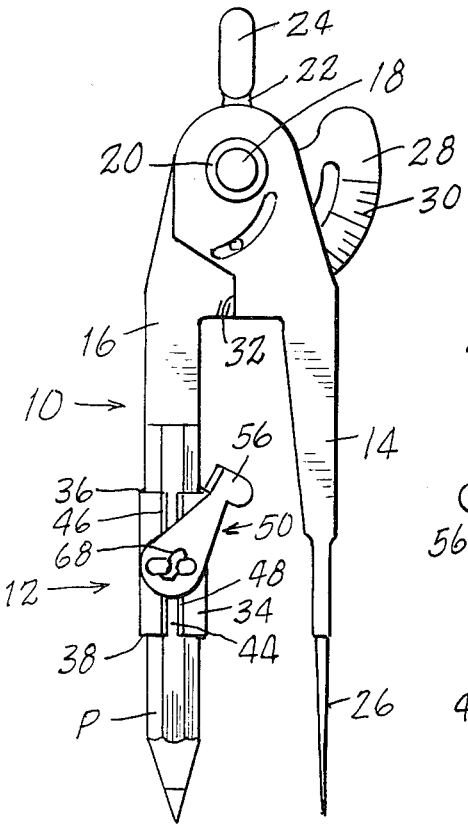
Fig. 3.
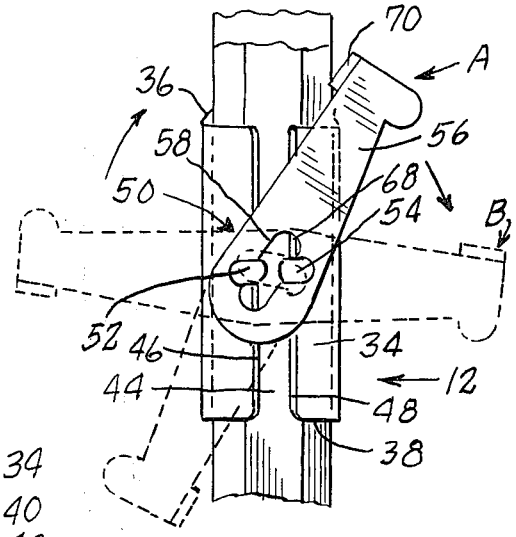
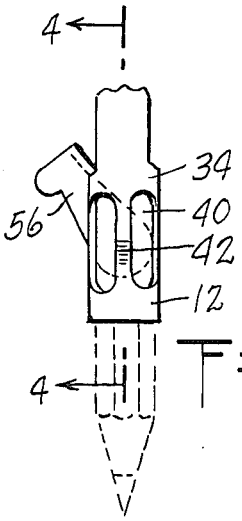
Fig. 2.
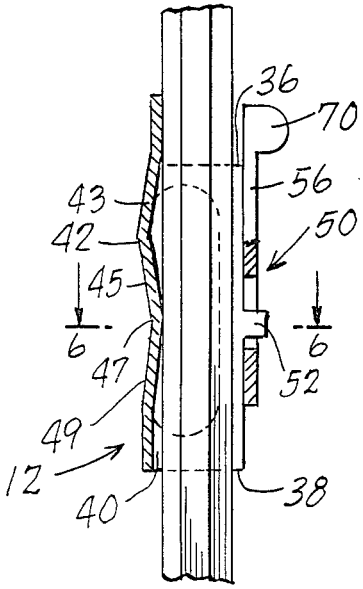
Fig. 4.
Fig. 6.
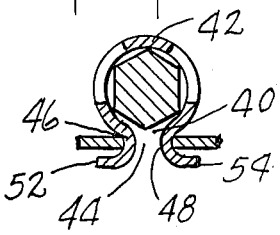
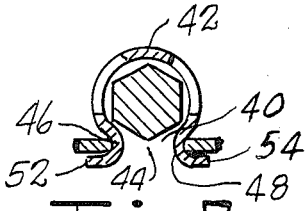
Fig. 7.
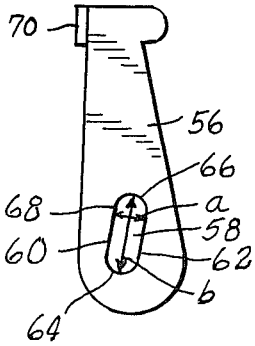
Fig. 5.

COMPASS PENCIL CLAMP

BACKGROUND OF THE INVENTION

The present invention relates generally to drawing compasses and specifically to an improved writing implement or pencil clamp for use in conjunction with a drawing compass. While the present invention is intended to be used with drawing compasses using any writing implement, the use of a pencil is described herein. It should be appreciated that wherever the term "pencil" is used, any writing implement can be substituted unless the context indicates otherwise.

The use of a compass to draw a circle or a portion of an arc is well known in the art and a large variety of differing compasses have been produced. The present invention is concerned specifically with that type of compass which employs the use of a writing implement, preferably a pencil, to describe the arc or circle produced. Basically, a drawing compass comprises two legs which are connected together at their top ends by a pivot rivet. A pintle or handle is secured to the pivot rivet, which handle facilitates the spinning of that leg of the compass holding the pencil about the second leg, the second leg being provided with a sharp point and placed at the center of the circle or arc to be drawn.

The prior art pencil clamps extend from one leg of the compass and comprise a flexible cylindrical band having a top and bottom opening, thus defining a central channel. The cylindrical band is longitudinally split to define a side opening and two edges; each edge being provided with an outwardly extending ear. A pencil passes through the central channel and is held in position by a clamping mechanism. This clamping mechanism comprises a clamping lever having an eccentric shaped slot through which the ears of the cylindrical band pass. By turning the clamping lever the continuous wall of the slot serves as a camming wall for the ears thereby drawing the edges of the cylindrical band closer together, narrowing the width of the side opening, and thus clamping the cylindrical band about the pencil.

The drawing compass is a relatively inexpensive item and is generally designed for mass production manufacture and low selling price. A persistent problem which had existed in the manufacture of drawing compasses has been the difficulty in producing a mechanism which will easily, accurately and securely clamp the pencil within the compass and at the same time, be relatively inexpensive to manufacture.

Included within the disadvantages of the prior art clamps for drawing compasses has been their general failure to solve the problems connected with the requirement for easy removal of the pencil for sharpening, the accurate initial positioning of the pencil point upon insertion of the pencil into the clamp, the readjustment of the pencil position relative to the pointed stationary leg of the compass as the pencil point becomes worn, the ability of the compass pencil clamp to fixedly secure pencils of varying diameters and the physical damage to the pencil due to the clamping action.

While some of these problems were solved by the compass constructed in accordance with U.S. Pat. No. 3,020,641, this compass construction suffers from the disadvantage that it required that the clamping lever be provided with a specially designed and machined slot. The slot provides camming walls for the ears of the cylindrical band thereby facilitating the opening, closing and locking of the clamp about the pencil.

Generally, it is an object of the present invention to provide a pencil clamp for use in a drawing compass which eliminates the disadvantages of the prior art pencil clamps as described above. Specifically, it is an object of the present invention to provide a pencil clamp for a drawing compass which will fixedly, accurately and firmly secure a pencil, including pencils having relative small diameters, to one leg of the compass and which will, in addition, allow for the selective easy positioning and movement of the pencil. It is thus an object of the present invention to provide a pencil clamp which holds normal-sized pencils securely in place and, in addition, is adapted to hold and secure pencils having relatively smaller diameters.

Another object of the present invention is to eliminate the necessity for specially machining the slot of the clamping lever by providing a clamping lever having a slot which is far simpler, cheaper and easier to manufacture.

Still further, it is an object of the invention to provide a slot for a clamping lever which provides a camming wall which enables the cylindrical band to tightly clamp the writing implement, to an even tighter degree than capable of being performed by the prior art clamps.

SUMMARY OF THE INVENTION

The present invention comprises a pencil clamp which is an integral part of one of the legs of a conventional drawing compass. The pencil clamp comprises a cylindrical band of flexible material having a top and bottom opening and a longitudinal side opening which extends the length of the cylindrical band and defines two parallel edges. The cylindrical band defines a channel for holding a pencil. Two outwardly protruding ears are provided to the parallel edges of the cylindrical band at points opposite to one another and are preferably bent backwards around the cylindrical band. A rotatable clamping lever has a slot cut therein which defines a continuous camming wall. In the preferred embodiment, the slot has parallel side edges and semicircular end edges, is engaged about the protruding ears such that upon rotation of the clamping lever the ears are drawn together providing a clamping action, i.e., the distance between the ears is decreased, thereby decreasing the width of the longitudinal side opening. As the width of the side opening is decreased the internal diameter of the channel of the cylindrical band is likewise decreased, thereby clamping a pencil contained within the channel.

The present invention specifically contemplates that the cylindrical band be provided with a flexible longitudinal rib running along the length of the cylindrical band and extending into the channel between the top and bottom opening of the cylindrical band. Upon rotation of the clamping lever to effectuate a clamping action, the side ears are drawn together thereby forcing the pencil tightly against the inwardly protruding rib. In this manner, the pencil clamping mechanism can accommodate pencils of varying diameters and, in addition, provide a significantly more secure holding of all pencils including those of normal diameter. The rib serves to positively secure the pencil in relative position within the clamp. It should be appreciated that one of the principal disadvantages of the prior art pencil compass clamps is their inability to accurately and firmly retain pencils both of small diameter and or normal diameter in an absolute fixed position during use. The present invention, by utilizing a longitudinally extending and inwardly directed rib eliminates the disadvantages of the prior art.

In the preferred embodiment of the present invention the longitudinal rib is located directly opposite the longitudinal side opening of the cylindrical band. However, it is contemplated that the rib could be located elsewhere about the circumference of the cylindrical band so long as it is directed inwardly toward the center of the channel of the cylindrical band.

The present invention also contemplates a clamping lever which is an improvement over the clamping lever described in U.S. Pat. No. 3,020,641. The clamping lever described in U.S. Pat. No. 3,020,641 includes a specially designed and machined slot through which the outwardly projecting ears of the cylindrical band extend. The slot of this clamping lever is provided with a positioning extension serving to prevent the clamping lever from passing beyond a predetermined point and thus providing a positive lock in position of the clamping lever. In its operation the side walls of the slot of the clamping lever provide camming walls for the ears.

The present invention eliminates the positioning extension of the clamping lever slot thereby eliminating the necessity for the clamping lever to be specially machined and, therefore, enables the clamping lever to be mass produced, with far greater manufacturing dimension tolerances allowed, without sacrificing function. The present invention contemplates that the slot of the clamping lever be generally oval-shaped having a continuous camming wall comprised of two parallel side walls and semi-circular end walls. In another embodiment of the present invention, the slot has an eliptical form having the same semi-circular end walls, yet in this embodiment the side walls converge toward the geometric center of the slot. This latter embodiment facilitates the clamping action by drawing together, ever further than able to be accomplished by use of the oval-shaped slot, the ears of the cylindrical band thereby producing a tighter clamping action. By drawing the ears of the cylindrical band closer together, i.e., further decreasing the width of the side opening, the pencil clamp of the present invention is fully capable of accommodating pencils of varying diameters.

BRIEF DESCRIPTION OF THE DRAWINGS

FIG. 1 is a side elevational view of a drawing compass incorporating a pencil clamp according to the preferred embodiment of the present invention;

FIG. 2 is a fragmentary rear view of the pencil clamp of the drawing compass shown in FIG. 1; the pencil is shown in ghost lines;

FIG. 3 is an enlarged fragmentary view of the pencil clamp of the drawing compass shown in FIG. 1; the ghost lines indicating rotation of the clamping lever;

FIG. 4 is a cross-sectional view taken along lines 4—4 of FIG. 2 and looking in the direction of the arrows;

FIG. 5 is an elevational view of the rotatable clamping lever showing the slot and camming wall;

FIG. 6 is a cross-sectional view taken along lines 6—6 of FIG. 4 and looking in the directing of the arrows; and FIG. 7 is a cross-sectional view taken along lines 6—6 of FIG. 4 and looking in the direction of the arrows, after the clamping lever has been rotated to the ghost line position designated "B" as shown in FIG. 3.

DETAILED DESCRIPTION OF THE PREFERRED EMBODIMENT

Referring now specifically to the drawings, there is shown in FIG. 1 a drawing compass, generally labeled by the numeral 10, incorporating a writing implement or pencil clamp generally designated by the numeral 12. The drawing compass 10 is of conventional structure and is comprised of two legs 14 and 16 which are pivotally joined at their upper ends by a pivot rivet 18. Frictional clamping forces are provided between the two legs 14, 16 by the pivot rivet 18, spring washers 20 (only one is shown), and the center plate 22 which itself is provided with a center post or handle 24. Pivot rivet 18, spring washer 20, center plate 22 and the legs 14, 16 are assembled in a manner which is well known to those skilled in the art, such that the center post 24 always bisects the angle between the compass legs 14, 16. Leg 14 has a pointed member 26 attached to its lower portion, about which leg 16 pivots when the drawing compass 10 is used. Leg 16 has an arcuate extension 28 which extends inwardly and beyond leg 14 and serves as an index of the radius of the arc or circle described by drawing compass 10. Scale 30, inscribed on the extension 28 co-acts with an index marker 32 of leg 14 to provide an accurate radius reading. In use, the operator of drawing compass 10 places pointed member 26 at the center of an arc or circle to be formed and, with the pencil P, supported in the holder 12, center post 24 is rotated so as to swing leg 16 about stationary pointed member 26 to thereby describe an arc or circle.

The writing implement or pencil clamp 12, best seen in FIGS. 2–4, consists of a flexible cylindrical band 34 having a top opening 36 and a bottom opening 38. Cylindrical band 34 thus defines an internal channel 40 through which the writing implement or pencil P passes, and it is there held during use of the drawing compass. The internal diameter of channel 40, with cylindrical band 34 in its "relaxed" or unstressed condition, is greater than the diameter of the pencil P desired to be held.

Cylindrical band 34 has a longitudinal side opening 44 extending parallel to leg 16 and running the length of cylindrical band 34. Side opening 44 defines two juxtaposed parallel side edges 46, 48 which define the width of side opening 44. Since cylindrical band 34 is constructed of a flexible material, the width of side opening 44, i.e., the distance between side edges 46 and 48, may be selectively varied.

Cylindrical band 34 is also provided with a flexible rib 42 which extends longitudinally along the axis of cylindrical band 34 and projects inwardly into channel 40 between top opening 36 and bottom opening 38. Rib 42, as best seen in FIG. 4, comprises an outward extension 43 which extends from cylindrical band 34 and projects outwardly beyond the outside diameter of cylindrical band 34, an inward extension 45, connected to outward extension 43 on one end with its other end 47 extending inwardly into channel 40, and a second outward extension 49 connected to inward extension 45 at end 47 and merging into the outside diameter of cylindrical band 34. Rib 42 is adapted and constructed so that upon tightening of the cylindrical band 34, rib 42 presses against and secures in position the writing implement or pencil P (see FIG. 4). Since longitudinal rib 42 is flexible, cylindrical band 34 can accommodate pencils or other writing implements of various diameters while still maintaining them in accurate placement.

In the preferred embodiment of the invention, rib 42 is located directly opposite side opening 44. However, it should be appreciated that rib 42 can be located anywhere about the circumference of the cylindrical band 34 as long as it is directed inwardly into channel 40.

It will be appreciated that a decrease of the width of side opening 44 performed by a lateral movement toward each other of the parallel side edges 46, 48 causes the internal diameter of channel 40 to decrease thereby causing clamp 12 to positively grip a writing implement or pencil P disposed therein. Additionally, lateral movement of side edges 46, 48 toward one another, thereby decreasing the internal diameter of channel 40, causes an increased portion of longitudinal rib 42 to bear upon and press against the writing implement or pencil P. This action fixedly secures the writing implement or pencil in the exact and proper orientation desired with respect to drawing compass 10 and especially with respect to pointed member 26.

A clamping mechanism 50 is provided to achieve the clamping action of the writing implement or pencil clamp 12. A pair of clamping ears 52, 54 extend outwardly from cylindrical band 34 at opposing points along parallel side edges 46, 48 of side opening 44. Ears 52, 54 are bent away from the side opening 44 and are partially folded back against the outside surface of cylindrical band 34.

A rotatable clamping lever 56 (see FIG. 5), having a slot 58 cut therein, is operative to engage ears 52, 54 to provide a clamping or tightening action of cylindrical band 34 around the writing implement or pencil P. Slot 58 is, in the preferred embodiment, comprised of parallel side edges 60, 62 and semi-circular end edges 64, 66. The edges of slot 58, i.e., 60, 62, 64 and 66, define a continuous camming wall 68 for lateral movement of ears 52, 54. Extending along the longer axis of slot 58 is dimension "b" which is greater than the corresponding transverse dimension "a" extending perpendicular to dimension "b".

Referring once again to FIG. 3, ears 52, 54 are disposed within slot 58 and are engaged by camming wall 68. Clamping lever 56 is provided with a finger tab 70 disposed at the outward extremity of lever 56 and at right angles thereto thus providing a convenient means for facilitating the rotation of clamping lever 56. When the clamping lever 56 is oriented with respect to ears 52, 54 as is shown in the solid line position designated "A" in FIG. 3, ears 52, 54 will engage camming wall 68 across the shorter dimension "a" thereby bringing the side edges 46, 48 closer together. Thus, side opening 44 is decreased in width and the effective internal diameter of channel 40 of cylindrical band 34 will be reduced to clamp and secure the writing implement or pencil P therein. As previously mentioned, this clamping activity is significantly enhanced by the positive force exerted between rib 42 and the writing implement or pencil P.

When the rotatable clamping lever 56 is rotated in a clockwise direction, as again viewed in FIG. 3, to the first ghost-line position generally designated "B", ears 52, 54 will engage camming wall 68 of the slot 58 across its greater dimension "b". Thus, the flexible cylindrical band will be relaxed or unstressed and longitudinal side opening 44 will be at its maximum width, i.e., edges 46, 48 will be spread apart and, therefore, the effective diameter of channel 40 of the cylindrical band 34 will be at its maximum, thus releasing the clamping action on the writing implement or pencil P previously disposed therein. This allows the writing implement or pencil P to be removed or adjusted, as desired.

When clamp 12 is in its unstressed condition, i.e., clamping lever 56 is positioned so that ears 52, 54 bear upon semi-circular end edges 64 and 66 of camming wall 68, inwardly extending end 47 of longitudinal rib 42 will merely contact the writing implement or pencil P. This allows easy movement and positioning of the pencil with respect to the drawing compass 10. However, once clamping lever 56 is rotated so as to bring ears 44, 46 closer together, thereby clamping the cylindrical band 34 about the writing implement or pencil P, then end 47 of longitudinal rib 42 will bear upon and press against the writing implement or pencil P to effectively prevent any and all relative vertical movement of pencil P with respect to drawing compass 10 and specifically pointed member 26.

In an alternate embodiment of the present invention, slot 58 of clamping lever 56 is provided with side edges which taper to form a pinched ellipse shape, i.e., the side edges converge to two opposing points on camming wall 68 which are positioned equidistant from the semi-circular end edges 64 and 66. Thus, an even smaller dimension "c" (not shown) of slot 58 of clamping lever 56 is provided which is smaller than dimension "a" of the embodiment shown in FIG. 5. When clamping lever 56 is rotated so that ears 52, 54 are positioned across dimension "c", cylindrical band 34 will be even further tightened and side opening 44 will be at its minimum width thereby clamping writing implement or pencil P to an even further extent. This latter embodiment is extremely useful for clamping small diameter pencils in clamp 12.

As will be readily apparent to those skilled in the art, the present invention may be realized in other specific forms without departing from its spirit or essential characteristics. The present embodiment is, therefore, to be considered as illustrative and not descriptive, the scope of the invention being indicated by the claims rather than by the foregoing descriptions, and all changes which come within the meaning and range of equivalence of the claims are therefore intended to be embraced therein.

I claim:

1. A writing implement holder for use with a drawing compass having first and second legs pivotally joined to one another proximate their ends, said first leg having a pointed lower end providing a pivot about which said compass can be rotated, said second leg having an arcuate extension to indicate the radius of the arc described by said compass, wherein said writing implement holder comprises a flexible cylindrical band formed as a lower extension of the second leg of said compass, said flexible cylindrical band having a top and bottom opening defining an internal channel which receives a writing implement, said flexible cylindrical band having a longitudinal side opening parallel to and coextensive with the cylindrical band, said flexible cylindrical band having a flexible rib integrally formed therewith and extending longitudinally along the axis of said band opposite said longitudinal said opening, said flexible rib having an inward extension projecting into the internal channel between the top and bottom opening of said cylindrical band and has one end joined to the top of the band and another end joined to the bottom of the band, said inward projection being intermediate the ends of said flexible rib, a pair of clamping ears formed on the opposite edges of said side opening extending outwardly from said side opening, said clamping ears being bent away from said opening and partially folded back towards the outside surface of said cylindrical band, a clamping lever having a slot with parallel side edges and semicircular end edges engaging said ears, said slot defining a camming wall through which said ears protrude, said ears being engaged by said camming wall, and said clamping lever being effective upon rotation to draw said ears and said side opening together to secure said writing instrument in said cylindrical band by engagement with the flexible rib or to allow said ears and said side opening to spread apart to release the writing implement.

* * * * *